United States Patent [19]

Koichi et al.

[11] Patent Number: 5,006,896

[45] Date of Patent: Apr. 9, 1991

[54] IMAGE DENSITY CONTROL METHOD FOR AN IMAGE FORMING APPARATUS

[75] Inventors: Yasushi Koichi, Yamato; Norimasa Sohmiya, Soka; Kazunori Karasawa, Tokyo, all of Japan

[73] Assignee: Ricoh Company, Ltd., Tokyo, Japan

[21] Appl. No.: 431,826

[22] Filed: Nov. 6, 1989

[30] Foreign Application Priority Data

Nov. 8, 1988 [JP] Japan ..... 63-280431

[51] Int. Cl.[5] ..... G03G 21/00

[52] U.S. Cl. ..... 355/246

[58] Field of Search ..... 355/246, 214, 208, 204, 355/203

[56] References Cited

U.S. PATENT DOCUMENTS

| | | | |
|---|---|---|---|
| 4,313,671 | 2/1982 | Kuru | 355/246 X |
| 4,829,336 | 5/1989 | Champion et al. | 355/246 |
| 4,833,506 | 5/1989 | Kuru et al. | 355/246 X |
| 4,878,082 | 10/1989 | Matsushita et al. | 355/246 X |

*Primary Examiner*—A. T. Grimley
*Assistant Examiner*—Sandra L. Hoffman
*Attorney, Agent, or Firm*—Oblon, Spivak, McClelland, Maier & Neustadt

[57] ABSTRACT

A method applicable to an image forming apparatus which is implemented by an electrophotographic procedure for maintaining that the density of images to be produced by the apparatus is adequate at all times. When the density of a toner image of a reference image or a predetermined pattern sensed by the image density sensor lies in a predetermined adequate range, a sensing level associated with the toner density sensor responsive to the toner density of a developer is not changed. When the density of the toner image does not lie in the adequate range, it is determined that at least the sensing level of the toner density sensing being used at that time has to be changed. Then, whether or not the sensed density of the toner image of the reference image exists in a range in which the image density is controllable is determined. If the sensed density lies in the controllable range, the sensing level of the density sensor being used at that time is suitably changed in response to the sensed density of the toner image. If otherwise, i.e., when the image density sensor is in a fault, toner density control is continued without changing the sensing level of the toner image sensor being used.

9 Claims, 5 Drawing Sheets

IMAGE DENSITY CONTROL METHOD FOR AN IMAGE FORMING APPARATUS

BACKGROUND OF THE INVENTION

The present invention relates to an image forming apparatus of the type using an electrophotographic procedure and, more particularly, to a method of maintaining the density of images to be produced by such an apparatus to be adequate at all times.

With an electrophotographic copier, facsimile machine, laser beam printer or similar image forming apparatus, it is a common practice to control the toner concentration or density of a developer to an adequate level for the purpose of stabilizing the quality of a toner image to be formed on a photoconductive element or similar image carrier or to be transferred to a paper sheet. Various approachs have heretofore been proposed to implement such a control over the toner density. One of them is to form a toner image representative of a reference density pattern having a reference density on a photoconductive element, sense the density of the toner image by using a reflection type photosensor which is constituted by a light emitting and a light-sensitive element, compare the sensed density and a predetermined reference density, and then control the supply of toner in response to the result of the comparison. Another approach is such that a toner density sensor is disposed in a developing unit to sense the mixture ratio of toner and carrier of a developer in terms of inductance, whereby the supply of toner is controlled in response to a change in inductance. Further, the supply of toner may be controlled by sensing a change in a current which flows through a developer. All of the prior art methods have merits and demerits, as follows.

The photosensor scheme, for example, promotes accurate control over toner density because it directly senses the density of a developed toner image, i.e., the final image, optically. However, the light emitting and light-sensitive elements of the phtosensor are positioned so close to the surface of a photoconductive element that they are apt to be smeared by toner particles which are scattered around during operation. This causes the photosensor to malfunction and bring the toner density out of control. The approach implemented by a toner density sensor which is disposed in a developing unit cannot detect the toner density with accuracy because the sensor is susceptible to the influence of so-called spent toner, for example, which exists in a developer but does not contribute to development. Even if the toner density sensor may accurately sense toner density to allow toner supply to be controlled in response to its output, the potential of a latent image formed on a photoconductive element is effected by the deterioration of the element and charges as well as changes in ambient conditions with no regard to the toner density, so that the density of the final toner image is not always adequate.

The image density sensor and the toner density sensor discussed above may be combined to insure stable image density control at all times, as has also been proposed in the past. For example, in a control method disclosed in Japanese Patent Laid-Open Publication (Kokai) No. 57-136667, the toner density sensor accommodated in a developing unit senses toner density of a developer, and the sensed toner density is compared with a predetermined reference value or toner sensing level. In response to the result of the comparison, the amount of toner supply is adjusted to control the toner density of the developer. On the other hand, the reflection type image density sensor located near the surface of a photoconductive element senses the toner density of a reference image, i.e., a toner image produced by developing a latent image of a reference image which is formed on the element in a certain pattern. Whether or not the density sensed by the image density sensor lies in a normal controllable range is then determined. If it lies in such a range, whether or not the sensed density of the toner image of the reference image is equal to an adequate level is determined. If the result of the decision is positive, a print mode operation is executed. If otherwise, whether the sensed density is higher or lower than the adequate level is determined. If the sensed density is higher than the adequate level, the above-mentioned reference value is switched to a smaller value; if otherwise, it is switched to a larger value. In this manner, the reference value serving as a predetermined reference level is varied on the basis of the density of the reference image sensed by the image density sensor.

Further, when the density of the toner image of the reference image sensed by the image density sensor does not lie in the controllable range, the prior art control method regards that the sensor is not operating properly due to one cause or another and decides to use the above-stated reference value as the toner density sensing level associated with the toner density sensor. Specifically, the toner density control is continued by using the reference value until the image density sensor recovers its function with the cause of the fault being cleared up. Should the reference value be changed in response to the toner density sensed by the image density sensor which is not normal, the new reference value or sensing level would become unusual. Controlling the toner density of the developer by adjusting the supply of toner in response to such a sensing level would naturally provide the toner with extraordinary density. If the toner density control is continued by using the reference value as a temporary measure as stated above, it is possible to use the apparatus efficiently in the event of the fault of the image density sensor because it is not necessary to interrupt the operation of the apparatus or the supply of toner. Of course, the control in such a condition is different from the ordinary image density control.

While the image density sensor does not operate properly as stated above, the prior art method uses the predetermined reference level as a density sensing level associated with the toner density of the reference image and controls the toner density based on the reference density. The toner density attainable with such a control is not accurate although accuracy will be restored in due course. Specifically, the reference level or sensing level is selected beforehand by taking account of the kind and characteristics of a developer to be used as well as the ambient conditions. Hence, the reference value selected beforehand will not always be optimal at the time of fault of the image density sensor due to the aging of the developer and the changes in ambient conditions which may occur before the fault. This will be seen from the fact that the prior art method does not fix the reference value, i.e., the reference value is variable. It follows that implementing the reference level by the predetermined reference level at the time of fault, even if it may be temporary, prevents the toner density from being controlled with accuracy.

SUMMARY OF THE INVENTION

It is therefore an object of the present invention to provide an image density control method which controls the density of an image produced by an image forming apparatus to an adequate level at all times.

It is another object of the present invention to provide an image density control method which controls toner density accurately even when an image density sensor responsive to the toner image of a reference image is defective.

It is another object of the present invention to provide a generally improved image density control method for an image forming apparatus.

In accordance with the present invention, in a method of constantly controlling a density of an image produced by an image forming apparatus at an adequate density by using an image density sensor responsive to a density of a toner image which is formed on an image carrier of the apparatus by developing a latent image by a developer, and a toner density sensor responsive to a toner density of the developer, the toner density sensed by the toner density sensor being compared with a density sensing level set beforehand for adjusting an amount of toner supply in response to a result of comparison, a latent image of a reference image having a predetermined pattern is electrostatically formed on the image carrier, and the latent image is developed by a toner. A density of a developed toner image of the reference image is sensed by the image density sensor. When the sensed density of the toner image of the reference image lies in a predetermined image controllable range, the density sensing level of the toner density sensor is changed depending on a degree of the sensed density and, when the sensed density does not lie in the predetermined image controllable range, the amount of toner supply is controlled in response to an output of the toner density sensor without changing the density sensing level and by using the density sensing level being used.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
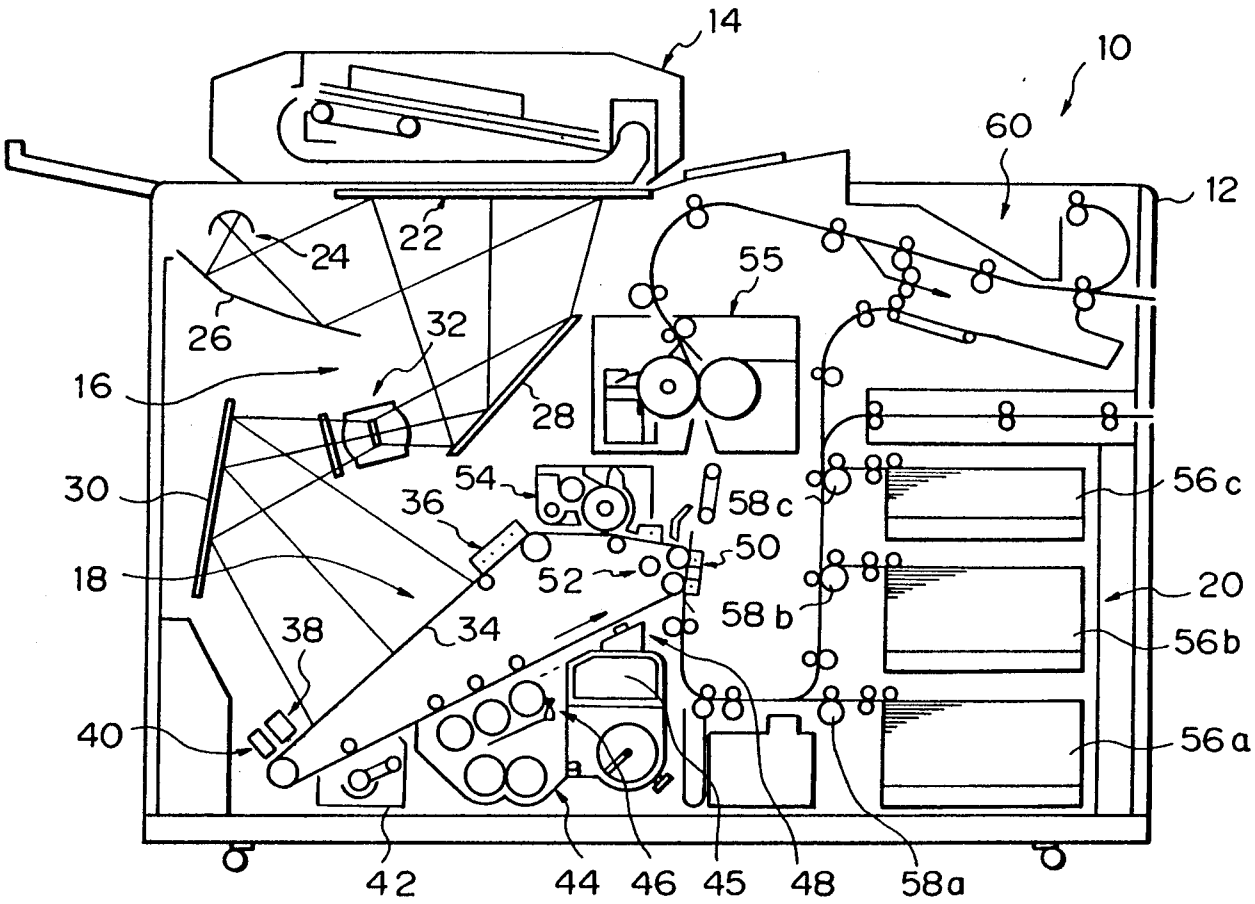
FIG. 1 is a sectional side elevation showing a copier which is a specific form of image forming apparatus to which the present invention is applicable.

Referring to FIG. 1 of the drawings, a copier belonging to a family of image forming apparatuses to which the present invention is applicable and generally designated is indicated by the reference numeral 10. As shown, the copier 10 is generally made up of a copier body 12 and an ADF (Automatic Document Feeder) 14 which is mounted on the top of the copier body 12. The copier body 12 accommodates therein optics 16, an image forming device 18, and a sheet feeding device 20. The optics 16 includes a lamp 24, a plurality of mirrors 26, 28 and 30, and a lens 32, as is well known in the art. The image forming device 18 has a photoconductive element in the form of a belt 34 and various process units which are arranged around the belt 34. Specifically, the process units comprise a main charger 36, a surface electrometer 38, an eraser 40, a sweeper 42, a developing unit 44 having thereinside a toner density sensor 46 which is responsive to the toner concentration of a developer, a charger 50 for image transfer and paper separation, a quenching lamp 52, a cleaning unit 54, and a fixing unit 55. A fresh toner is supplied from a toner hopper 45 to the developing unit 44. The eraser 40 electrostatically forms a latent image representative of a reference image, or predetermined pattern, on the photoconductive element. The sheet feeding device 20 has a plurality of trays 56*a*, 56*b* and 56*c*, feed rollers 58*a*, 58*b* and 58*c*, and a reverse feed unit 60 as is usual.

The image density sensor 46 is implemented by a light emitting and a light-sensitive element which face the surface of the belt 34, as with a conventional photosensor. The toner density sensor 46 may also be implemented by any of the sensors known in the art, e.g., a sensor of the type being buried in the developer in the developing unit 44 and sensing the mixture ratio of toner and carrier of the developer in terms of inductance to thereby sense toner density. If desired, the latent image of the reference image or predetermined pattern formed on the belt 34 by the eraser 40 may be replaced with a latent image of a reference density pattern which has a reference pattern and is formed on the belt 34 by the optics 16 and image forming device 34.

Figure 2:
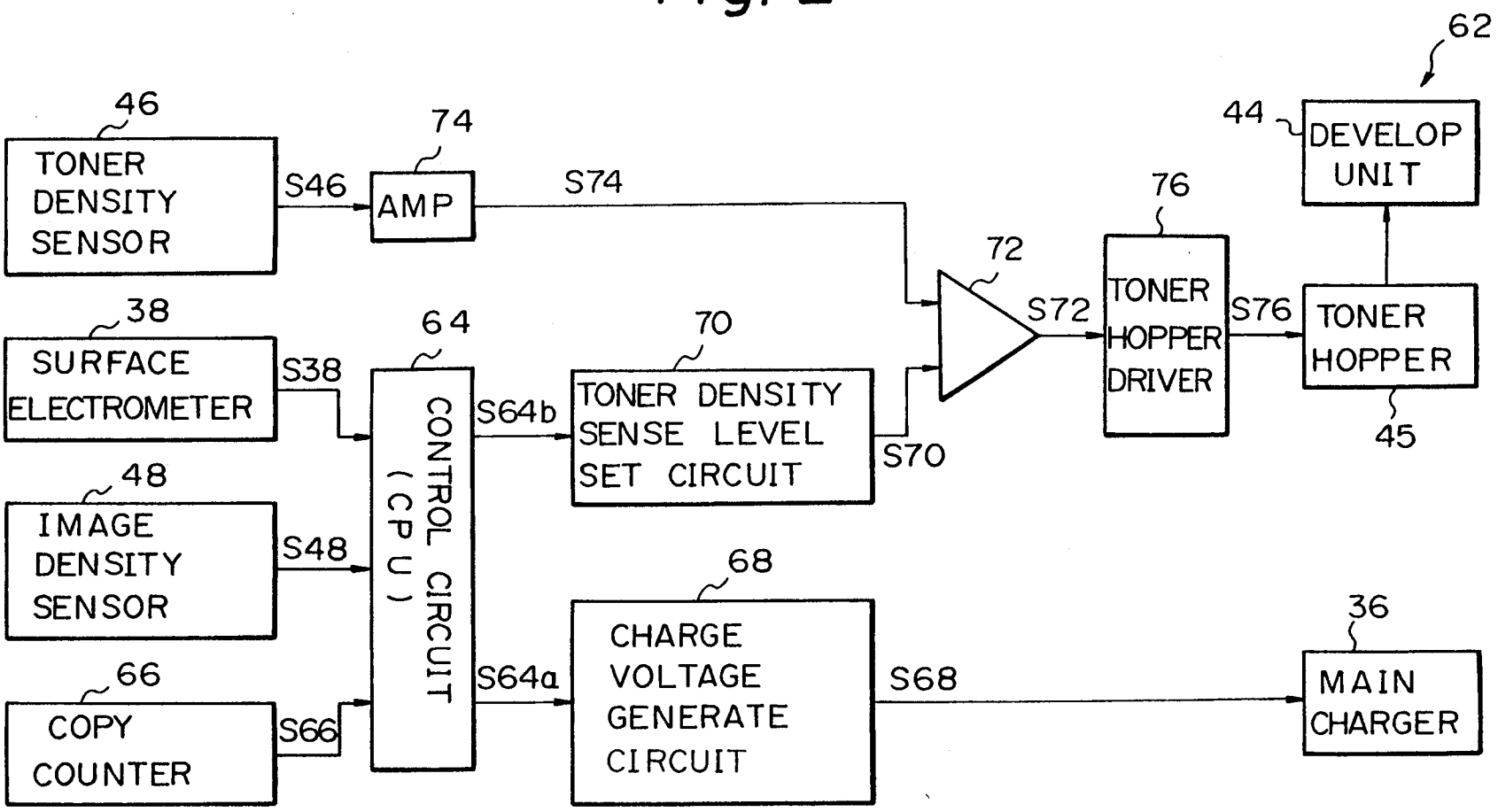
FIG. 2 is a schematic block diagram showing a specific construction of a control unit for practicing the method of the present invention.

Referring to FIG. 2, a control unit for practicing the image density control method of the present invention will now be described. The control unit, generally 62, has a control circuit 64 which may be constituted by a CPU (Central Processing Unit), for example. Connected to the control circuit 64 are the surface electrometer 38 and image density sensor 48 and a copy counter 66 which produce outputs signals S38, S48 and S66, respectively. In response to the signals S38, S48 and S66, the control circuit 64 feeds a charge voltage control signal S64*a* to a charge voltage generating circuit 68 so as to apply an adequate charging voltage to the main charger 36. Specifically, the charge voltage generating circuit 68 applies an adequate grid voltage S68 to the charger 36. In response to the output S48 of the image density sensor 48, the control circuit 64 delivers to a density sensing level setting circuit 70, which sets a toner density, a sensing level associated with the toner density sensor 46. The setting circuit 70 feeds to one input of a comparator 72 a signal S70 having a reference voltage Vr which corresponds to the sensing level set by the setting circuit 70. The reference voltage Vr is variable in response to the density of a toner image which is formed on the belt 34 and is sensed by the image density sensor 48. This implements accurate density control which is not achievable with the toner density sensor 46 only due to the aging of the developer and changes in ambient conditions as discussed previously. Sensing the toner density of the developer in the developing unit 44, the toner density sensor 46 delivers a signal S46 having a voltage Vd which corresponds to the sensed toner density to the other input of the comparator 72 via an amplifier 74. The comparator 72 compares the voltage Vd of an output signal S74 of the amplifier 74 with the voltage Vr of the signal S70. If the voltage Vd is higher than the reference voltage Vr, the comparator 72 feeds a control signal S72 to a toner hopper driver 76. In response, the toner hopper driver 76 feeds a toner or a developer containing a predetermined ratio of carrier to the developer which exists in the developing unit 44.

When the image density sensor 48 is brought out of its normal operating condition, the illustrative embodiment allows the image density control to be continued without the need for interrupting the operation of the copier 10 or the toner supplying operation. If the toner density sensing level is set in response to the image density sensed by the sensor 48 which is in fault, the set value, i.e., the reference voltage Vr, will reach an extraordinary level. In the illustrative embodiment, when such a fault of the image density sensor 48 is detected, the change in toner density sensing level based on the output of the image density sensor 48 is not executed. More specifically, it is inhibited to change sensing level in response to the failure of the sesnsor 48. Instead, until the image density sensor 48 restores its function with the cause of the fault being cleared up, the sensing level set by the toner density sensing level setting circuit 70 immediately before the occurrence of the fault is continuously used as the sensing level of the toner density sensor 46. This makes it possible to control the toner density with a sensing level which is set up by taking account of the aging of the developer and the changes in ambient conditions that have been observed immediately before the fault.

Figure 3A:
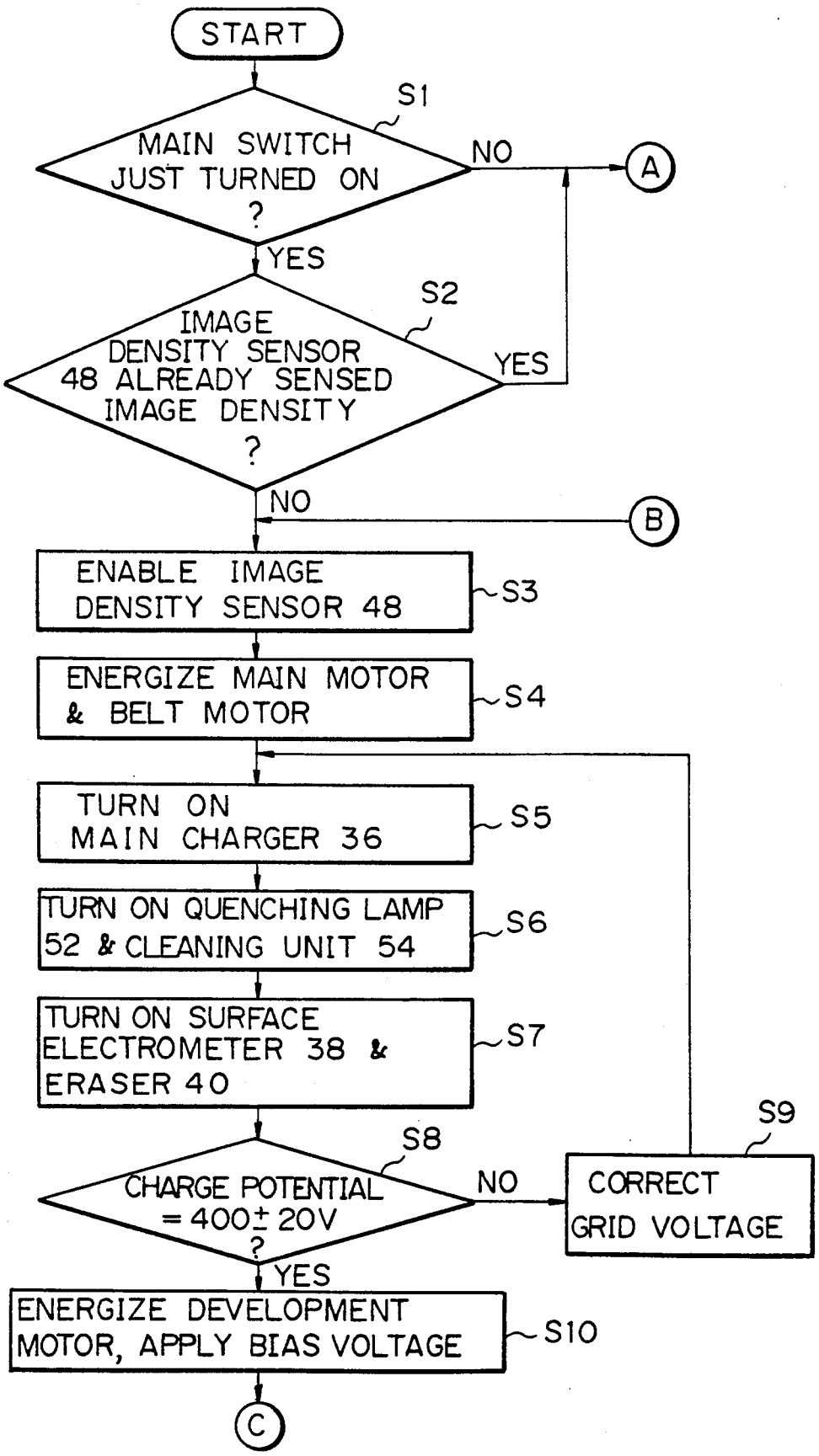
FIGS. 3A to 3C are flowcharts demonstrating the operations of the circuitry shown in FIG. 2.
Figure 3B:
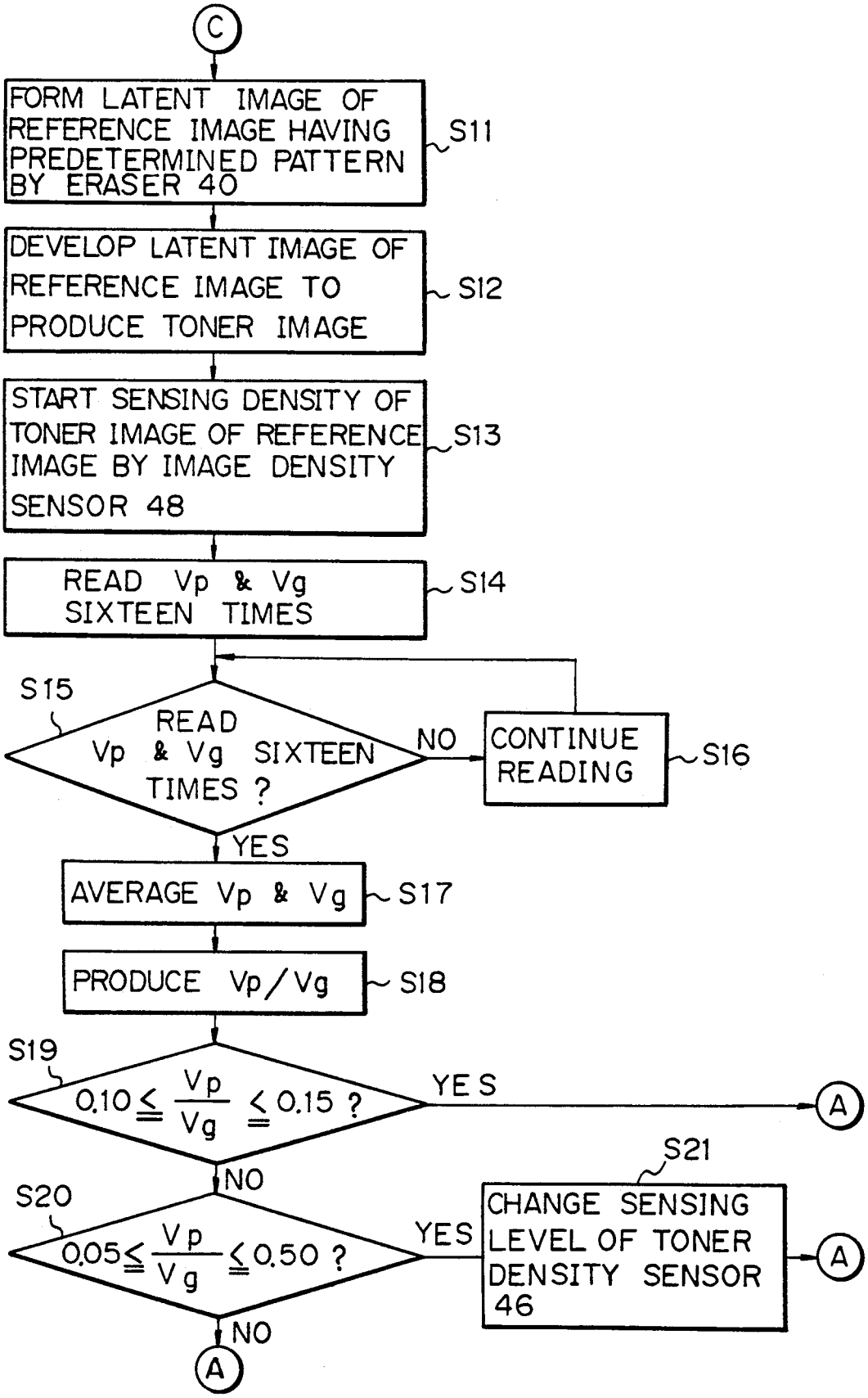
Figure 3C:
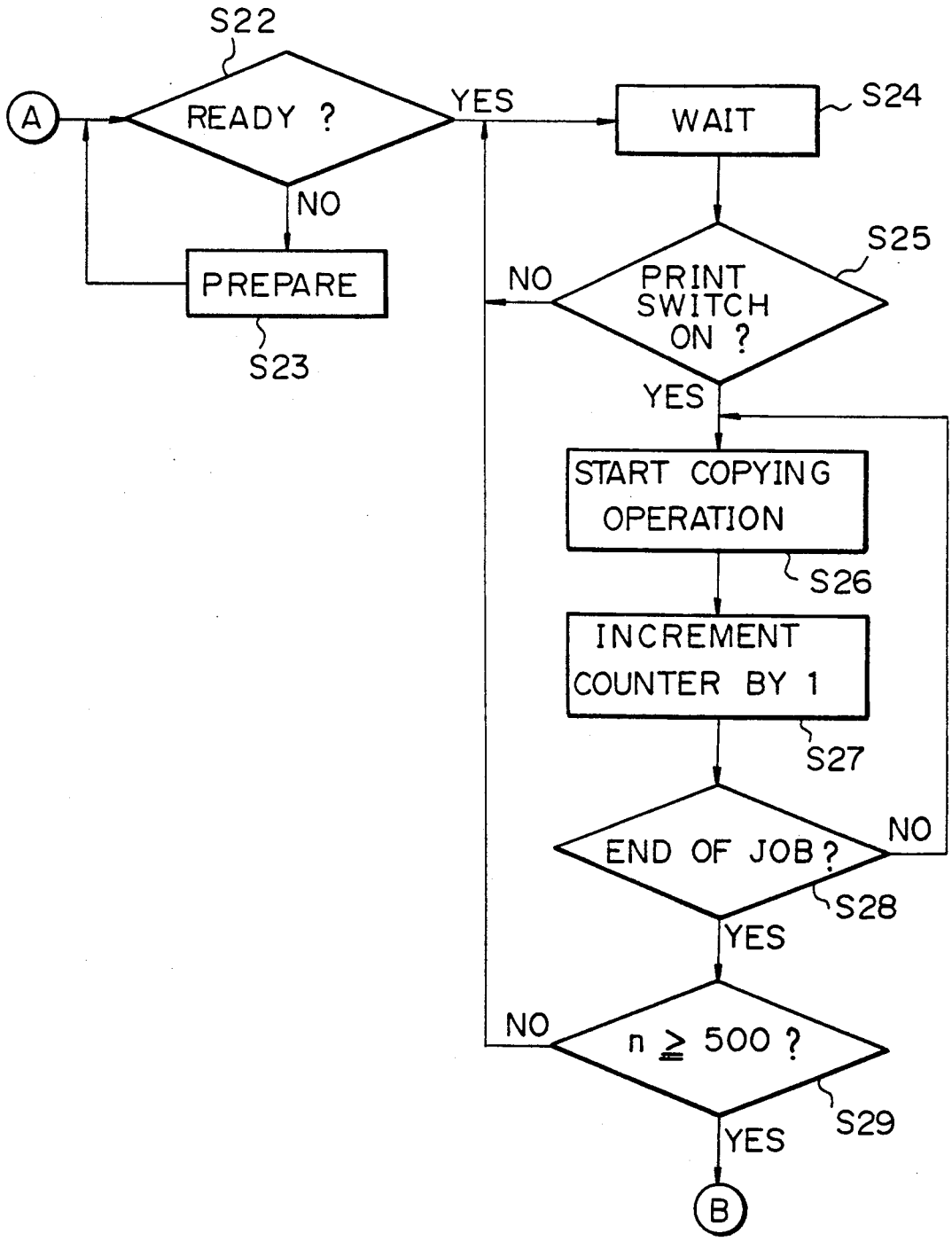

Referring to FIGS. 3A, 3B and 3C, the operation of the illustrative embodiment will now be described specifically. In this embodiment, immediately after a main switch of the copier 10 has been pressed or when the counter 66 has counted 500 copies, an image density sensing mode which uses the image density sensor 48 is set up. In a step S1, whether or not the main switch has been turned on is determined. If the answer of the step S1 is YES, whether or not the image density sensor 48 has already sensed an image density is determined (step S2). If the answer of the step S2 is NO, the program enters into an image density sensing mode. Specifically, the image density sensor 48 is enabled (step S3), a main motor and a belt motor are energized (step S4), the main charger 36 is activated (step S5), the quenching lamp 52 and cleaning unit 54 are turned on (step S6), and the surface electrometer 38 and eraser 40 are turned on (step S7). After such a preparatory stage, the grid voltage of the main charger 36 is controlled, i.e., it is controlled such that the potential of a latent image of a predetermined pattern to be formed on the belt 34 by the eraser 40 equals a predetermined potential, e.g. 400±20 volts (step S8). This predetermined potential has a value which is immune to, among others, fluctuations in of the amount of exposing light when the copier 10 is in a magnification changing mode operation, for example. If the grid voltage is not equal to a predetermined potential, it is corrected (step S9). If the former is equal to the latter, a motor associated with the developing unit 44 is energized while a bias voltage for development begins to be applied (step S10). The developing unit 44 is now ready to develop a latent image. It is noteworthy that while the developing unit 44 is operable, the toner density sensor 46 continuously senses the toner density of the developer to allow toner supply to be effected in response to an output thereof as needed. The eraser 40 is turned on, off and on in this sequence within a short period of time to electrostatically form a latent image of a predetermined pattern having a predetermined width (e.g. 30 millimeters) on the belt 34 which has been charged to a predetermined potential (step S11). The latent image is developed by the developing unit 44 with the result that a toner image representative of a reference image is formed on the belt 34 (step S12). At this instant, since the predetermined bias voltage is applied to the developing unit 44, an image density corresponding to the density of the developer is provided on the belt 34.

Subsequently, the image density sensor 48 starts sensing the density of the toner image of the reference image formed on the belt 34 as described above (step S13). The image density sensor 48 produces a potential associated with the density of the toner image of the reference image and, at the same time, senses the potential in the background area on the belt 34. Hence, the output signal S48 of the sensor 48 includes a voltage Vp associated with the sensed density of the toner image of the reference image and a voltage Vg associated with the sensed potential of the background area. In the illustrative embodiment, the voltages Vp and Vg are repetitively read a plurality of times (e.g. sixteen times) in order to enhance the reliability of the signal S48. Whether the voltages Vp and Vg have been read sixteen times is determined (step S15). If the answer of the step S15 is NO, they are further read (step S16). If the answer of the step S15 is YES, the voltages Vp and Vg are averaged individually (step S17). This is followed by a step S18 for producing a ratio of the resulting mean value of the voltages Vp to that of the voltages Vg, i.e. Vp/Vg (step S18). Then, whether the ratio Vp/Vg lies in a predetermined adequate density range, i.e., 0.10 to 0.15 is determined (step S19). If the answer of the step S19 is YES, the toner density control is continued by using the sensing level having been set in the toner density sensor 46 at that time. If the answer of the step S19 is NO, the program decides that at least the sensing level has to be changed. Thereafter, whether the ratio Vp/Vg exists in another predetermined range, i.e., a range of 0.05 to 0.50 in which the image density is controllable is determined (step S20). If the answer of the step S20 is YES, the sensing level of the toner density sensor 46 is changed depending on whether the density of the toner image of the reference image having been sensed by the image density sensor 48 at that time is high or low (step S21). It is to be noted that if the answer of the step S1 is NO, an ordinary copying procedure is executed as represented by steps S22 to S29.

If the ratio Vp/Vg exceeds the controllable range of 0.05 to 0.50 as decided in the step S20, the program determines that the image density sensor 48 is in a fault due to one cause or another. In this condition, the sensing level of the toner density sensor 46 is not changed on the basis of the ratio Vp/Vg which exceeds the range of 0.05 to 0.50, and the toner control using the toner density sensor 46 is continued with the existing sensing level being maintained. Hence, accurate toner density control is insured which takes account of the aging of the developer and the changes in ambient conditions that may occur before that instant. Such a control mode continues until the image density sensor 48 recovers its function with the cause of the fault being cleared up. While the image density sensor 48 usually senses the density of the toner image of the reference image every time 500 copies are produced, the sensing interval of the sensor 48 is reduced while the sensor 48 is not normal, i.e., it senses the density every time a sequence of copying steps is completed. Such a shorter sensing interval is successful in examining the cause of failure more specifically and, therefore, in promoting easy processing even if such a fault occurs frequently.

In summary, the present invention uses an image density sensor and a toner density sensor in a unique combination. Specifically, when the density of a toner image of a reference image or a predetermined pattern sensed by the image density sensor lies in a predetermined adequate range, a sensing level associated with the toner density sensor responsive to the toner density of a developer is not changed. When the density of the toner image does not lie in the adequate range, it is determined that at least the sensing level of the toner density sensing being used at that time has to be changed. Then, whether or not the sensed density of the toner image of the reference image exists in a range in which the image density is controllable is determined. If the sensed density lies in the controllable range, the sensing level of the density sensor being used at that time is suitably changed in response to the sensed density of the toner image. If otherwise, i.e., when the image density sensor is in a fault, toner density control is continued without changing the sensing level of the toner image sensor being used. With such a procedure, even when the image density sensor is not operating properly, it is possible to continue toner density control in response to the output of the toner density sensor without interrupting the copying operation. Moreover, while the image density sensor is in a fault, the present invention realizes accurate toner density control by taking account of the aging of a developer and the changes in ambient conditions.

Various modifications will become possible for those skilled in the art after receiving the teachings of the present disclosure without departing from the scope thereof.

What is claimed is:

1. A method for controlling a density of an image produced by an image forming apparatus constantly to an adequate density by using an image density sensor responsive to a density of a toner image which is formed on an image carrier of said apparatus by developing a latent image by a developer, and a toner density sensor responsive to a toner density of said developer, said toner density sensed by said toner density sensor being compared with a density sensing level set beforehand for adjusting an amount of toner supply in response to a result of comparison, said method comprising the steps of:

(a) electrostatically forming a latent image of a reference image having a predetermined pattern on the image carrier, and developing said latent image by a toner;

(b) sensing a density of a developed toner image of the reference image by the image density sensor;

(c) changing, when the sensed density of the toner image of the reference image lies in a predetermined controlled range, the density sensing level of the toner density sensor depending on a degree of said sensed density and controlling, when said sensed density does not lie in said predetermined image controllable range, the amount of supply in response to an output of the toner density sensor without changing said density sensing level and by using said density sensing level being used; and (d) controlling, when the density of the toner image sensed by step (b) lies in an adequate image density range, controlling the supply of toner in response to an output of toner density sensor without changing the density sensing level and by using said density sensing level being used, and executing the step (c) when said density does not lie in said adequate image density range.

2. A method as claimed in claim 1, wherein step (b) comprises:

(e) detecting a voltage Vp associated with the density of the developed toner image of the reference image and a voltage Vg associated with a background area of the image carrier;

(f) producing mean values of said individual voltages Vp and Vg; and (g) calculating a ratio Vp/Vg of the mean value of said voltage Vp to the mean value of said voltage Vg.

3. A method as claimed in claim 2, step (c) comprises (h) determining whether or not the ratio Vp/Vg produced by step (g) exists in said image controllable range.

4. A method as claimed in claim 3, wherein said image controllable range is 0.05 to 0.50.

5. A method as claimed in claim 2, wherein step (d) comprises (h) determining whether or not the ratio Vp/Vg produced by step (g) exists in said adequate image density range.

6. A method as claimed in claim 5, wherein said adequate image density range is 0.10 to 0.15.

7. A method as claimed in claim 1, wherein step (c) comprises reducing a sensing interval of the image density sensor when the sensed density of the toner image of the reference image does not lie in said image controllable range.

8. A method as claimed in claim 7, wherein step (d) comprises (e) enabling the image density sensor every time a sequence of copying steps is completed.

9. A method of controlling a density of an image produced by an image forming apparatus constantly to an adequate density by using an image density sensor responsive to a density of a toner image which is formed on an image carrier of said apparatus by developing a latent image by a developer, and a toner density sensor responsive to a toner density of said developer, said toner density sensed by said toner density sensor being compared with a density sensing level set beforehand for adjusting an amount of toner supply in response to a result of comparison, said method comprising the steps of:

(a) electrostatically forming a latent image of a reference image having a predetermined pattern on the image carrier, and developing said latent image by a toner;

(b) sensing a density of a developed toner image of the reference image by the image density sensor; and (c) changing, when the sensed density of the toner image of the reference image lies in a predetermined image controllable range, the density sensing level of the toner density sensor depending on a degree of said sensed density and controlling, when said sensed density does not lie in said predetermined image controllable range, the amount of toner supply in response to an output of the toner density sensor without changing said density sensing level and by using said density sensing level being used;

wherein step (c) comprises (d) reducing a sensing interval of the image density sensor when the sensed density of the toner image of the reference image does not lie in said image controllable range.

* * * * *